US005729612A

United States Patent [19]

Abel et al.

[11] Patent Number: 5,729,612

[45] Date of Patent: Mar. 17, 1998

[54] METHOD AND APPARATUS FOR MEASURING HEAD-RELATED TRANSFER FUNCTIONS

[75] Inventors: Jonathan Stuart Abel, Palo Alto; Scott Haines Foster, Groveland, both of Calif.

[73] Assignee: Aureal Semiconductor Inc., Fremont, Calif.

[21] Appl. No.: 286,873

[22] Filed: Aug. 5, 1994

[51] Int. Cl.[6] ..... H04R 29/00

[52] U.S. Cl. ..... 381/56; 381/17; 381/1

[58] Field of Search ..... 381/56, 58, 59, 381/17, 18, 60, 1, 26; 128/746; 73/585

[56] References Cited

U.S. PATENT DOCUMENTS

| | | | |
|---|---|---|---|
| 4,052,560 | 10/1977 | Santmann | 381/98 |
| 4,809,708 | 3/1989 | Geisler et al. | 128/746 |
| 5,077,799 | 12/1991 | Cotton | 381/57 |
| 5,208,860 | 5/1993 | Lone et al. | 381/17 |
| 5,500,900 | 3/1996 | Chen et al. | 381/17 |

OTHER PUBLICATIONS

Han, "Measuring a Dummy Head in Search of Pinna Cues," *J. Audio Eng. Soc.*, vol. 42, Jan./Feb. 1994, pp. 15–37.

Struck an Temme, "Simulated Free Field Measurements," *J. Audio Eng. Soc.*, vol. 42, No. 6, Jun. 1994, pp. 467–482.

Lehnert, "Auditory Spatial Impression," *Proc. AES 12th Int. Conf.*, Jun. 1993, pp. 40–46.

Golay, "Complementary Series," *IRE Trans. Info. Theory*, vol. 7, Apr. 1961, pp. 82–87.

Butler, et al., "Spectral Cues Utilized in the Localization of Sound in the Median Sagittal Plane," *J. Acoust. Soc. Am.*, vol. 61, May 1977, pp. 1264–1269.

Schroeder, "Integrated–Impulse Method Measuring Sound Decay Without Using Impulses," *J. Acoust. Soc. Am.*, vol. 66(2), Aug. 1979, pp. 497–500.

Borish, et al., "An Efficient Algorithm for Measuring the Impulse Response Using Pseudorandom Noise," *J. Audio Eng. Soc.*, vol. 31(7), Jul./Aug. 1983, pp. 478–488.

Foster, "Impulse Response Measurement Using Golay Codes," *Int. Conf. Acoust., Speech and Sig. Proc.*, 1986, pp. 929–931.

George, et al., "Estimating Steady–State Response of a Resonant Transducer in a Reverberant Underwater Environment," *ICASSP*, Apr. 1988, pp. 2737–2740.

Oppenheim, et al., *Discrete–Time Signal Processing*, 1989, especially pp. 781–797.

Wightman, et al., "Headphone Simulation of Free–Field Listening. I: Stimulus Synthesis," *J. Acoust. Soc. Am.*, Feb. 1989, pp. 858–867, vol. 85(2).

(List continued on next page.)

*Primary Examiner*—Curtis Kuntz
*Assistant Examiner*—Ping W. Lee
*Attorney, Agent, or Firm*—Thomas A. Gallagher; David N. Lathrop

[57] ABSTRACT

A method and apparatus is capable of accurately deriving acoustic transfer functions such as head-related transfer functions (HRTF) at low cost. Various aspects of the invention include constraining the reflection geometry of a measurement system to facilitate removal of reflection effects, establishing ambient noise level and ambient reverberation time to calibrate test signals, generating soundfields using Golay code test signals, invalidating measurements by detecting test subject movement and short-duration ambient sounds, deriving distance and/or interaural time difference (ITD) using minimum-phase forms of impulse responses, and deriving equalized HRTF suitable for use in acoustic displays without knowing output or input transducer acoustical properties. Spatial resampling of derived HRTF and spectral shaping of test signals are discussed.

10 Claims, 8 Drawing Sheets

OTHER PUBLICATIONS

Middlebrooks, et al., "Directional Sensitivity of Sound Pressure Levels in the Human Ear Canal," *J. Acoust. Soc. Am.*, Jul. 1989, pp. 89–108, vol. 86(1).

Ainsleigh, et al., "Modeling Exponential Signals in a Dispersive Multipath Environment," *ICASP*, Mar. 1992, pp. V–457 to V–460.

Wenzel, et al., "Localization Using Nonindividualized Head–Related Transfer Functions," *J. Acoust. Soc. Am.*, vol. 94(1), Jul. 1993, pp. 111–123.

Vanderkooy, "Aspects of MLS Measuring Systems," *J. Audio Eng. Soc.*, vol. 42, No. 4, Apr. 1994, pp. 219–231.

Wightman et al, "Perceptual Consequences of Engineering Compromises in Synthesis of Virtual Auditory Objects", J. Acoust. Soc. Am., vol. 92, No. 4, Pt. 2, Oct. 1992.

Martens, William L., "Principal Components Analysis and Resynthesis of Spectral Cues to Perceived Direction", 1987 ICMC Proceedings, pp. 274–281, 1987.

METHOD AND APPARATUS FOR MEASURING HEAD-RELATED TRANSFER FUNCTIONS

TECHNICAL FIELD

The invention relates in general to the measurement of auditory transfer functions and more particularly to low-cost method and apparatus for accurately measuring auditory transfer functions such as head-related transfer functions.

BACKGROUND

There is a growing interest in the field of acoustics to improve methods and systems for developing models of the transfer of acoustic energy by a sound field from one point to another. A frequency-domain expression of such models is referred to as an acoustic transfer function (ATF).

Deriving ATF, at a basic level, comprises generating a soundfield in response to a test signal at some point $p_1$, measuring a response to the soundfield at some point $p_2$, and deriving an expression from the measured response, the test signal, and the positions $p_1$ and $p_2$. This basic process may be used with a wide variety of media conducting the soundfield including gases, fluids and/or solids. A transfer function obtained in this manner is a frequency-domain expression which is generally a function of frequency $\omega$ and relative position $(d,\theta,\phi)$ between points $p_1$ and $p_2$, or $H(d,\theta,\phi,\omega)$, where $(d,\theta,\phi)$ represents the relative position of the two points in polar coordinates. Other coordinate systems may be used. A corresponding time-domain impulse response representation is generally a function of time t and relative position between points $p_1$ and $p_2$, or $h(d,\theta,\phi,t)$.

An acoustic output transducer is used to generate the sound field in response to a test signal. Examples of output transducers include loudspeakers, including electromagnetic and piezo-electric devices, plasmatic gases, musical instruments, office and industrial machinery, a voice, or an explosive. Any device which generates acoustic energy in response to a signal may be used; however, some transducers are generally more suitable than others.

An acoustic input transducer is used to measure the response to the soundfield. Examples of input transducers include microphones, including electromagnetic and piezo-electric devices, hydrophones and strain gauges. Any device which generates a signal in response to acoustic energy may be used.

A basic process using only output and input transducers can be used to establish acoustical properties of the transducers themselves. For example, the sound field generated by a loudspeaker can be measured by a microphone at various points about the loudspeaker to establish the frequency response and dispersal characteristics of the loudspeaker. Similarly, a soundfield can be generated from various points about a microphone and the measured response to the soundfield can be used to establish the frequency response characteristics and directional sensitivity of the microphone.

The basic process may be augmented by introducing a test subject into the soundfield. In this manner, the acoustical properties of the test subject may be established by deriving a suitable ATF for points in, on or around the test subject. A wide variety of test subjects are possible including, for example, acoustic panels, boat and aircraft structures, rooms and concert halls. A test subject may also be a person or a model of a person. ATF which model the acoustic properties of a human torso, head and ear pinnae are referred to herein as head-related transfer functions (HRTF).

HRTF describe, with respect to a given soundfield, the acoustic levels and phases which occur at ear locations on the head. The HRTF is typically a function of both frequency and relative orientation between the head and the source of the soundfield. Preferably, it is a free-field transfer function (FFTF) which expresses changes in level and phase relative to the levels and phase which would exist if the test subject was not in the soundfield; therefore, an FFTF may be generalized as a transfer function of the form $H(\theta,\phi,\omega)$. Throughout this discussion, the term HRTF and the like should be understood to refer to FFTF forms unless a contrary meaning is made clear by explanation or by context.

Practical considerations usually dictate that the process for deriving ATF must be performed within a structure such as a building or a tank. The acoustical ambience of these structures must be taken into account, otherwise ATF derived from a measured response will be influenced by the ambient effects and provide a distorted acoustical model. Two important effects are ambient reflections and ambient noise.

Ambient reflections obscure the acoustic characteristics under test. Techniques for reducing ambient reflections include reflection-cancellation processing and anechoic chambers. These techniques have disadvantages.

The accuracy of reflection models is generally unknown and introduce a degree of uncertainty into the measurements. For example, one attempt to cancel the effects of reflections comprises constructing a model of the ambient reflections, estimating the ambient reflections by applying the model to the test signal used to generate the soundfield, and subtracting the estimated ambient reflections from the measured response. Various techniques for reflection cancellation are discussed in Ainsleigh and George, "Modeling Exponential Signals in a Dispersive Multipath Environment," *Int. Conf. Acoust., Speech and Sig. Proc.*, March 1992, pp. V-457 to V-460, and in George, Jain and Ainsleigh, "Estimating Steady-State Response of a Resonant Transducer in a Reverberant Underwater Environment," *Int. Conf. Acoust., Speech and Sig. Proc.*, April 1988, pp. 2737–2740, both of which are incorporated by reference in their entirety.

Anechoic chambers are very expensive to construct and do not eliminate reflections, especially at low frequencies. First-order reflections are usually attenuated by no more than about 30 to 40 dB. If a device is used to support or stabilize a human test subject's head, the device will contribute to reflections. In addition, the test subject cannot be seen in an anechoic chamber unless a monitor such as closed-circuit television is used. Unfortunately, the monitor degrades the anechoic property of the chamber. Monitoring and restricting human test subject movement is very important because even very small movements can invalidate measurements.

Ambient noise degrades the signal-to-noise ratio (SNR) of the measured responses, thereby decreasing the reliability and accuracy of these measurements. A SNR of at least 60 dB is generally thought necessary. Techniques commonly used to improve measurement SNR include taking measurements in so called sound-proof rooms, increasing the level of the soundfield to increase the level of the measured responses, and using pseudorandom noise test signals or long test signals so that the effects of ambient noise can be reduced mathematically. An example of a pseudorandom noise test signal is the maximum-length sequence (MLS). Additional information regarding the use of pseudorandom noise test signals in general and MLS test signals in particular may be obtained from Schroeder, "Integrated-Impulse Method Measuring Sound Decay Without Using Impulses," *J. Acoust. Soc. Am.*, vol. 66, August 1979, pp. 497–500, Borish and Angell, "An Efficient Algorithm for Measuring the Impulse Response Using Pseudorandom Noise," *J. Audio Eng. Soc.*, vol. 31, July/August 1983, pp. 478–488, and Vanderkooy, "Aspects of MLS Measuring Systems," *J. Audio Eng. Soc.*, vol. 42, April 1994, pp. 219–231, all of which are incorporated by reference in their entirety. These techniques have disadvantages.

Sound-proof rooms are very expensive to construct and, of course, are not truly sound proof.

The level of the soundfield can be increased only so much. The level is constrained by limits in output and input transducers such as power-handling capacity and linearity, and by limits imposed by the test subject. For human test subjects, the level must be limited for the sake of listening comfort and, in addition, measurements can be distorted by an involuntary reflex response to loud signals which is analogous to blinking in response to bright light. In extreme cases, the test subject may even flinch in response to loud acoustic signals.

Pseudorandom noise test signals may be used to increase SNR. Pseudorandom noise based on "maximum-length" sequences (MLS) are repeated digital sequences which have a power spectrum substantially the same as that of a single impulse. Because they are longer than an impulse, MLS do not require amplitudes exceeding equipment dynamic range to have sufficient power to achieve minimal SNR for measured responses. The theoretical SNR gain for a MLS of period L is 10 $\log_{10}L$. For example, the SNR gain for a sequence of period 1023 is 30 dB. Unfortunately, the measured response to MLS test signals contains a significant error at low frequencies.

The use of long test signals is not desirable because they usually generate standing waves in the measurement facility and they increase the likelihood that a human test subject will move while a measurement is taken.

Many applications comprise acoustic displays utilizing one or more HRTF in attempting to create for a listener realistic three-dimensional aural impressions. Acoustic displays using a particular HRTF can create realistic three-dimensional aural impressions by modelling the attenuation and delay of acoustic signals received at each ear as a function of frequency $\omega$ and apparent direction relative to head orientation $(\theta,\phi)$. An impression that an acoustic signal originates from a particular relative direction $(\theta,\phi)$ can be created by applying an appropriate HRTF to the acoustic signal, generating one signal for presentation to the left ear and a second signal for presentation to the right ear, each signal changed in a manner that mimics the respective signal that would have been received at each ear had the signal actually originated from the desired relative direction.

As a practical matter, an acoustic display can implement HRTF with one or more digital filters. In real-time systems, an efficient implementation of the filters is very desirable to reduce computational requirements and implementation costs. For example, if HRTF are implemented by one or more finite impulse response filters, it is desirable to use filters with as short a length as possible.

The HRTF varies considerably from one individual to another because of considerable variation in the size and shape of human torsos, heads and ear pinnae. Under ideal situations, the HRTF incorporated into an acoustic display is the personal HRTF of the actual listener because a universal HRTF for all individuals does not exist. Additional information regarding the suitability of shared HRTF may be obtained from Wightman and Kistler, "Multidimensional Scaling Analysis of Head-Related Transfer Functions," *IEEE Workshop on Applications of Sig. Proc. to Audio and Acoust.*, October 1993.

In many practical systems, however, several HRTF known to work well with a variety of individuals are compiled into a library to achieve a degree of sharing. The most appropriate HRTF is selected for each listener. Additional information may be obtained from Wenzel, et al., "Localization Using Nonindividualized Head-Related Transfer Functions," *J. Acoust. Soc. Am.*, vol. 94, July 1993, pp. 111–123.

Processes for deriving HRTF are usually performed in an anechoic chamber. The test subject is placed in a seat and asked to remain motionless as each measurement is performed because even a small movement such as swallowing can distort the measurements. Sometimes the head is supported in an apparatus or the test subject is asked to clench teeth on a fixed object to help hold the head motionless in a known position. For example, see Butler and Belenduik, "Spectral Cues Utilized in the Localization of Sound in the Median Sagittal Plane," *J. Acoust. Soc. Am.*, vol. 61, May 1977, pp. 1264–1269, and from Wightman and Kistler, "Headphone Simulation of Free-Field Listening. I: Stimulus Synthesis," *J. Acoust. Soc. Am.*, February 1989, pp. 858–867 (hereafter, "Wightman-Headphone"). Such devices do not eliminate test subject movement and they potentially distort the measurements. Many small movements are not detected, resulting in inaccurate measurements and inaccurate HRTF.

The problems created by test subject movement can be avoided by using inanimate models or dummies; however, the dummies are expensive to make, usually represent only one individual, and have acoustical properties of unknown accuracy.

Soundfields are generated from a plurality of positions about the head of the test subject by presenting test signals through a plurality of loudspeakers attached to a structure within the anechoic chamber or to a structure connected to the seat where the test subject is sitting. For example, see the Wightman-Headphone reference cited above, and Middlebrooks, Makous and Green, "Directional Sensitivity of Sound Pressure Levels in the Human Ear Canal," *J. Acoust. Soc. Am.*, July 1989, pp. 89–108. The use of many loudspeakers reduces or eliminates the need for mechanically changing the relative position of the test subject with respect to the loudspeakers. This allows measurements to be taken more quickly, thereby reducing the likelihood of test subject movement between measurements. Unfortunately, each loudspeaker has unique acoustical characteristics which must be accounted for in the derivation of the HRTF, and each loudspeaker and the supporting structure degrades the anechoic property of the chamber. In addition, mechanical and acoustical coupling between loudspeakers distort the generated soundfield.

The soundfield is measured in each ear by various types of microphones. Probe microphones are inserted into each ear canal to take measurements at a point near the ear drum; acoustic energy is conveyed by small tubes to a measuring device outside the ear canal. Additional information may be obtained from the Wightman-Headphone reference cited above. Blocked-meatus microphones are inserted into the ear canal to take measurements at a point near the opening of the canal. These microphones are discussed in more detail in Middlebrooks, et al., cited above.

Probe microphones are difficult to use. Trained personnel are needed to install a probe microphone to minimize risk of injury to a test subject because the microphone is inserted into the ear canal to a point very close to the ear drum. Placement is critical because the microphone must avoid the one or more acoustic nulls which exist in an ear canal. Even if the nulls are avoided initially, movement by the test subject can perturb the probe microphone enough to alter measurements.

Assuming proper installation can be achieved, measurements taken with probe microphones are degraded by a low signal-to-noise ratio (SNR) because the microphones have a small cross-sectional area and are therefore relatively insensitive. Test signals as long as two to five seconds are commonly used to achieve a satisfactory SNR; however, the probability of test subject movement during sequences of this length is very high. In addition, inaccuracies arise because acoustic energy is coupled between the soundfield and the small tubes conveying acoustic energy from the probe microphone to a measuring device. Ear canal resonance increases the length of the measured response and reduces the accuracy of some measurements, i.e., measurements are much more accurate for frequencies near the resonant frequency.

Blocked-meatus microphones are not widely used. As discussed in Middlebrooks, et al., cited above, the proper placement of the microphone required to avoid directional dependencies is not known and it is unclear whether a blocked-meatus microphone installed near the opening of the ear canal distorts the soundfield.

DISCLOSURE OF INVENTION

It is an object of the present invention to provide for a method and an apparatus which are inexpensive to implement, simple to use, and which are capable of establishing very accurate ATF and HRTF.

It is another object of the present invention to improve the quality of acoustic displays by providing for a method and an apparatus which are capable of deriving more accurate ATF and HRTF.

Many advantages are realized by various aspects of the present invention, including:

- avoiding the cost and inconvenience of constructing and using anechoic chambers;
- essentially eliminating the effects of ambient reflections and resonances;
- allowing acoustic signals to be generated at any relative direction to a test subject;
- greatly reducing the effects of test subject movement during measurements;
- eliminating the need to monitor a test subject with television cameras and the like;
- automatically invalidating measurements taken during test subject movement;
- accurately measuring relative position between acoustic source and test subject head;
- eliminating distortions caused by loudspeaker cross-coupling;
- eliminating inaccuracies introduced by inexact loudspeaker equalization;
- improving measurement SNR without requiring long or excessively loud signals;
- decreasing the processing resources required to implement a derived ATF or HRTF;
- eliminating inaccuracies caused by acoustic effects in the ear canal; and
- simplifying the method needed to install a microphone in a test subject ear.

Other advantages of the present invention may be appreciated by referring to the following discussion and to the accompanying drawings.

Various aspects of the present invention may be used to measure acoustical properties of transducers such as loudspeakers and microphones, of structures such as concert halls, auditoriums, and a wide variety of objects including acoustically reflective or absorptive materials. Furthermore, many aspects of the present invention are not limited to air and may be applied to other acoustical media such as water.

According to the teachings of one aspect of the present invention, an acoustic transfer function is derived using a measurement facility comprising an acoustic output transducer, an acoustic input transducer, and a structure with constrained acoustic reflection properties affecting acoustic signals originating at the output transducer and received at the input transducer. In particular, the structure is constrained such that the time of propagation of all reflections of acoustical energy originating from the output transducer off objects other than the output transducer and the input transducer exceeds the time of propagation of a direct acoustical signal from the output transducer to the input transducer by at least the response time of the impulse response corresponding to the acoustic transfer function. The acoustic transfer function is derived from signals obtained from the input transducer in response to a soundfield generated by the output transducer.

In an embodiment comprising a test subject, the acoustic reflection properties are constrained such that the time of propagation of all reflections of acoustical energy originating from the output transducer off objects other than the output transducer, the input transducer and the test subject exceeds the time of propagation of a direct acoustical signal from the output transducer to the input transducer by at least the response time of the impulse response corresponding to the acoustic transfer function. Generally, the acoustic input transducer is located at or near the surface of the test subject. In this context, the term "near" refers to locations close enough to the test subject to experience significant changes in the soundfield caused by the test subject.

According to the teachings of another aspect of the present invention, an acoustic transfer function is derived by obtaining a raw system impulse response from signals obtained from an acoustic input transducer in response to a sound field generated by an acoustic output transducer, obtaining a raw direct-path impulse response by removing the effects of acoustic reflections from the raw system impulse response, and deriving the acoustic transfer function from the raw direct-path impulse response. A "raw system impulse response" is the impulse response of the entire measurement facility system at the input transducer to a soundfield originating at the output transducer, including all reflections and the acoustical properties of the output and the input transducers. A "raw direct-path impulse response" is the impulse response at the input transducer to only a soundfield originating at the output transducer and traveling directly to the input transducer and including the acoustical properties of the output and the input transducers.

In one embodiment, the effects of reflections are removed from the raw system impulse response by extrapolating the raw system impulse response from an initial segment of the measured response. In another embodiment, the effects of reflections are removed from the raw system impulse response by estimating the effects of reflections using a reflection model applied to the test signal generating the sound field, and subtracting the estimate from the raw system impulse response.

According to the teachings of yet another aspect of the present invention, an acoustic transfer function is derived by obtaining a measured signal from an acoustic input transducer, placed at or near the surface of a test subject, in response to a soundfield generated by an acoustic output transducer, obtaining a reflection-free response signal by removing from the measured signal the effects of acoustic reflections other than those reflections from the test subject, and deriving the acoustic transfer function from the reflection-free response signal. In one embodiment, the effects of reflections are removed from the measured signal by extrapolating the measured signal from an initial segment of the measured response. In another embodiment, the effects of reflections are removed from the measured signal by estimating the effects of reflections using a reflection model applied to the test signal generating the sound field, and subtracting the estimate from the measured signal.

According to a further aspect of the present invention, an acoustic transfer function is derived by moving a test subject into a position relative to an acoustic output transducer, obtaining a measured signal from an acoustic input transducer, placed at or near the surface of the test subject, in response to a soundfield generated by an acoustic output transducer, and deriving the acoustic transfer function from the measured signal.

In one embodiment, the position of the test subject relative to the acoustic output transducer is established using position sensors. In another embodiment, the test subject is moved under computer control. In yet another embodiment, the test subject is moved under computer control in conjunction with the position being established using position sensors. In preferred embodiments, a single acoustic output transducer is used.

According to yet a further aspect of the present invention, an acoustic transfer function is derived by adjusting the relative position of a test subject with respect to an acoustic output transducer, obtaining a measured signal from an acoustic input transducer, placed at or near the surface of the test subject, in response to a soundfield generated by an acoustic output transducer, establishing a distance and/or one or more components of relative orientation between the output transducer and the test subject, and deriving the acoustic transfer function from the measured signal and the distance and/or the one or more components of relative orientation.

In one embodiment, the distance and/or one or more components of relative orientation are established by position-sensing transducers installed at known positions relative to the acoustic output transducer and the test subject. In another embodiment, the distance and/or one or more components of relative orientation are established from the measured signal. In yet another embodiment, if test subject movement relative to the output transducer is detected while obtaining a measured signal, the measured signal is deemed to be invalid and is not used to derive the acoustic transfer function.

According to another aspect of the present invention, an acoustic transfer function is derived by moving a test subject and/or a single acoustic output transducer into various positions relative to one another, obtaining a measured signal for each position from an acoustic input transducer, placed at or near the surface of the test subject, in response to a soundfield generated by the output transducer, and deriving the acoustic transfer function from the measured signal.

In one embodiment, the derived acoustic transfer function is equalized according to a single set of input/output transducer characteristics. In another embodiment, an acoustic transfer function for a particular acoustic display device is obtained directly from the measured signals without regard to input/output transducer characteristics.

According to the teachings of yet another aspect of the present invention, an acoustic transfer function is derived by obtaining a measured signal from an acoustic input transducer in response to a soundfield generated by an acoustic output transducer, and deriving the acoustic transfer function from the measured signal. The soundfield is generated in response to a test signal comprising a Golay code pair, the acoustic input transducer is placed at or near the opening of an ear canal of a test subject, and the soundfield is inhibited from propagating into the ear canal.

According to yet a further aspect of the present invention, a soundfield is displayed to a listener by an acoustic display using an acoustic transfer function derived in accordance with other various aspects of the present invention.

The present invention may be implemented in many different embodiments and incorporated into a wide variety of devices. Throughout this discussion, more particular mention is made of deriving HRTF for use with acoustic displays; however, it should be understood that the present invention is useful in a broader range of applications such as, for example, characterizing the acoustic properties of input and output transducers, and passive objects. The various features of the present invention and its preferred embodiments may be better understood by referring to the following discussion and to the accompanying drawings in which like reference numbers refer to like features. The contents of the discussion and the drawings are provided as examples only and should not be understood to represent limitations upon the scope of the present invention.

MODES FOR CARRYING OUT THE INVENTION

A. Basic System

Figure 1:
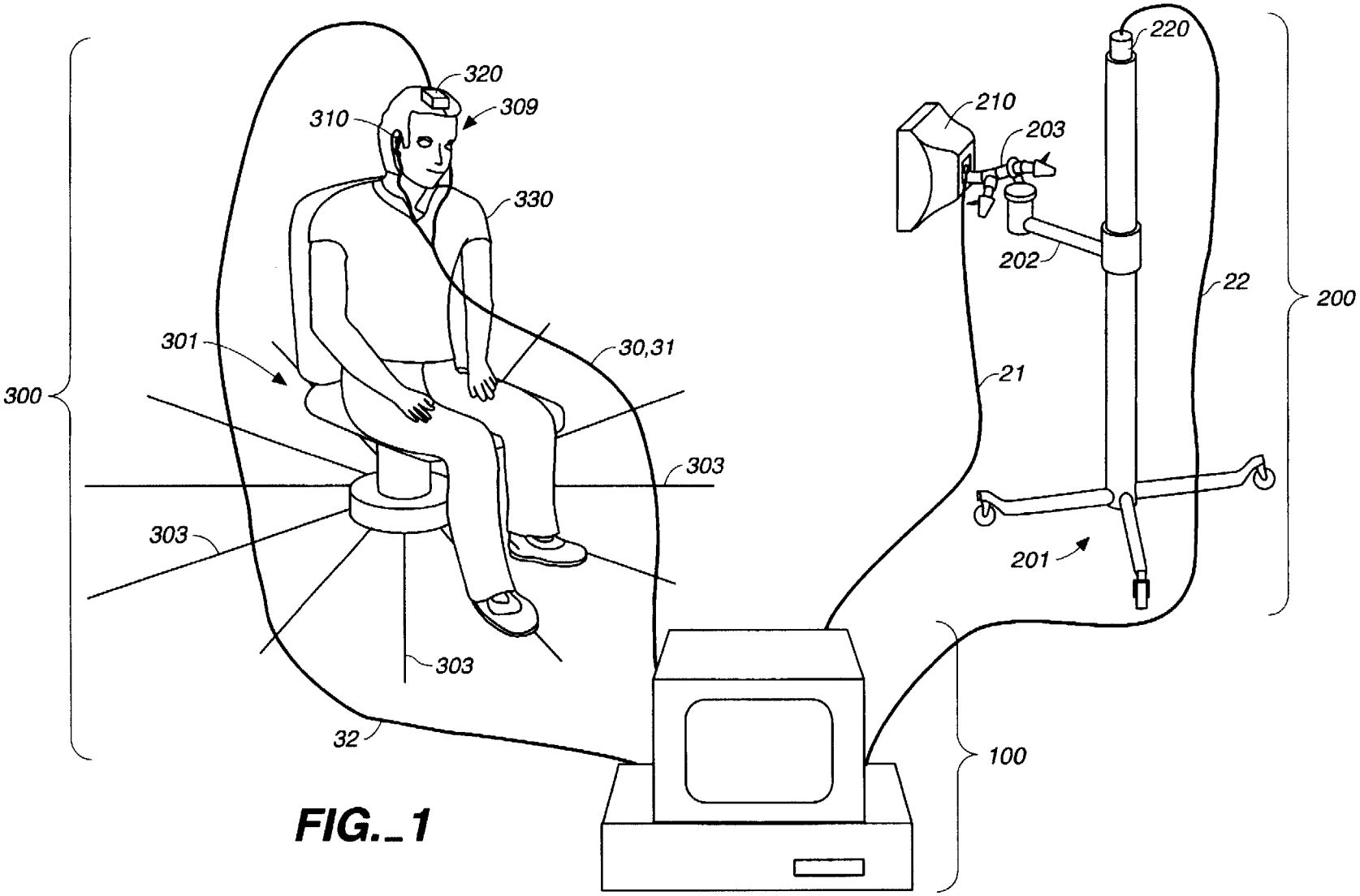
FIG. 1 is a schematic illustration one embodiment of a system incorporating various aspects of the present invention.

A schematic shown in FIG. 1 illustrates one embodiment of a system incorporating various aspects of the present invention which may be used to derive a head-related transfer function (HRTF). Control 100 generates a soundfield with output unit 200, measures the response to the soundfield with input unit 300, and processes the response to derive HRTF. Information carrying paths 21 and 22 between control 100 and output unit 200 and paths 30, 31 and 32 between control 100 and input unit 300 are depicted as wires, but any information carrying technique may be used, including wireless forms of communication using electromagnetic and/or acoustical energy throughout the spectrum. Of course, any technique used should be compatible with the need to accurately generate and measure soundfields. Control 100 is depicted as a desktop computer but no particular implementation is critical to the practice of the invention.

Output unit 200, in the example illustrated, comprises support 201 to which is mounted acoustic output transducer 210 and position sensor 220. Output transducer 210 generates a soundfield in response to a test signal received from control 100 along path 21. Position sensor 220 operates in conjunction with another position sensor described below. Signals between position sensor 220 and control 100 pass along path 22. Position sensor 220 is shown mounted at the top of support 201; however, the sensor may be mounted at any location provided its position with respect to acoustic output transducer 210 is known or can be established. For example, the sensor may be mounted directly on the output transducer if the two devices do not interfere with one another.

Input unit 300, in the example illustrated, comprises test subject 330 sitting on seat 301, left acoustic input transducer 309 mounted in the left ear of the test subject, right acoustic input transducer 310 mounted in the right ear of the test subject, and position sensor 320 mounted on the head of the test subject. Signals generated by the left acoustic input transducer and by the right acoustic input transducer in response to the soundfield are passed to control 100 along paths 30 and 31, respectively. Position sensor 320 operates in conjunction with position sensor 220 to establish the relative position between the two position sensors. Signals between position sensor 320 and control 100 pass along path 32. Position sensor 320 is shown mounted at the top of the head of test subject 330; however, the sensor may be mounted at any location provided its position with respect to the head is known or can be established.

Both position sensor 220 and position sensor 320 are referred to as sensors; however, it is possible that only one of the two units operates as an input device. The other unit may be only an output device or transmitter, for example. This distinction is not important. In another embodiment, both sensor 220 and sensor 320 are input devices and a third device, not illustrated, is a transmitter. The relative position of the two input devices can be easily ascertained. No particular sensor or sensing technique is critical to the practice of the present invention. Indeed, as will be discussed below, position sensors are not required to practice various aspects of the present invention.

B. Process

Figure 2:
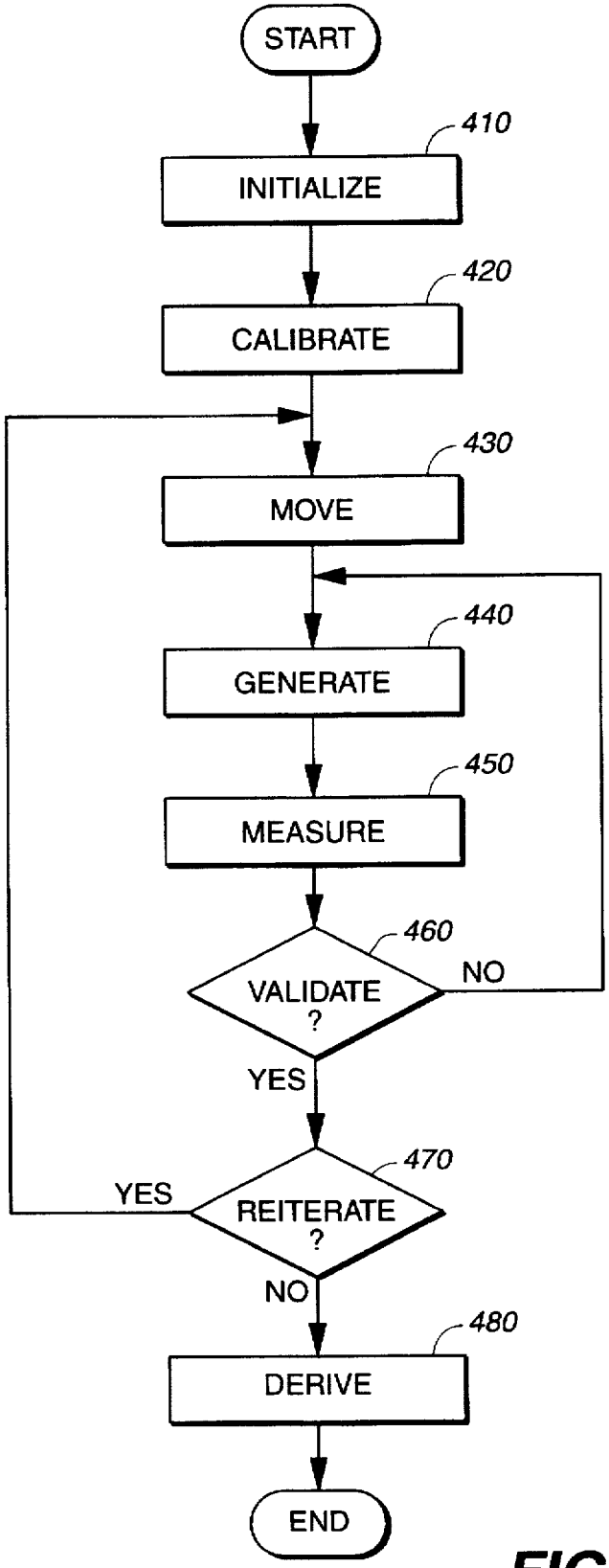
FIG. 2 is a flow diagram illustrating steps in one process for deriving HRTF in accordance with various aspects of the present invention.

FIG. 2 is a flow diagram illustrating steps in one process for deriving HRTF in accordance with various aspects of the present invention. It will be appreciated that many concepts and methods discussed here apply as well to processes for deriving various types of acoustic transfer functions (ATF), with or without a test subject, in addition to the particular type of ATF referred to as HRTF. For example, a following discussion pertaining to equalization when using a single acoustic output transducer applies to a process for deriving ATF for a microphone under test as well as it applies to a process for deriving HRTF.

Referring to FIG. 2, one basic process comprises the steps of INITIALIZE 410, CALIBRATE 420, MOVE 430, GENERATE 440, MEASURE 450, VALIDATE 460, REITERATE 470 and DERIVE 480 which are discussed below.

1. Initialize

Step INITIALIZE 410 initializes the measurement system. Initialization of a system such as that illustrated in FIG. 1 includes assembling and arranging the components comprising control 100, output unit 200 and input unit 300. Test subject 330 is placed on seat 301 and acoustic input transducers 309 and 310 are installed in the left and right ears of the test subject, respectively. In particular, support 201 and seat 301 are situated in such a manner to control acoustic reflections.

As mentioned above, one advantage of systems incorporating various aspects of the present invention is that anechoic chambers are not necessary. The use of anechoic chambers may be avoided in preferred embodiments by arranging components in the system such that arrival of all reflections at the acoustic input transducers is delayed by at least a specified amount of time. This arrangement may be better appreciated by referring to FIG. 3 in conjunction with the following discussion.

Figure 3:
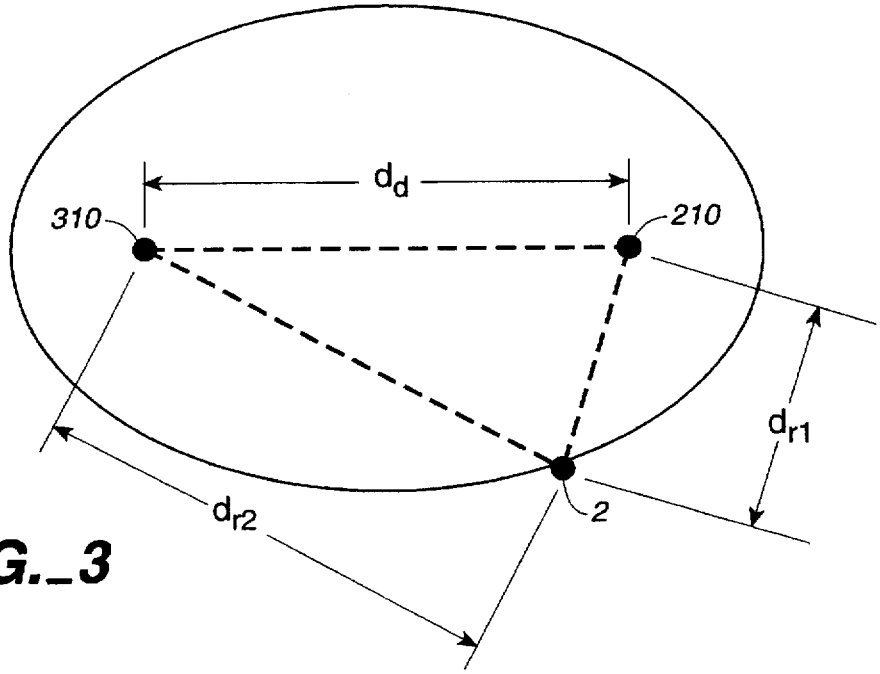
FIG. 3 is a hypothetical illustration of a direct path and a first-order reflection path between an output transducer and an input transducer.

FIG. 3 is a schematic representation of acoustic output transducer 210 and acoustic input transducer 310. The earliest arrival of acoustic energy in a soundfield generated by the output transducer at time to arrives at the input transducer at time $t_1$ along a direct path between the two transducers. For standard temperature and pressure at sea level, sound propagates through air at a speed of approximately 1100 feet per second, or approximately one foot per millisecond. Speeds and directions of propagation at other temperatures and pressures, or for other media, are generally known and are not discussed here. The time of direct-path propagation $t_d=(t_1-t_0)$ is proportional to the length of the direct-path $d_d$ between transducers.

Acoustic energy arriving at the input transducer after one or more reflections propagates along a longer path; therefore, it arrives after the arrival of energy which propagates along the direct path. Referring to FIG. 3, acoustic energy propagating from an output transducer at point 210 to an input transducer at point 310 along a path with a reflection at point 2 arrives at the input transducer at time $t_2$. The time of reflected propagation $t_r=(t_2-t_0)$ is proportional to the length of the reflected path $d_r=d_{r1}+d_{r2}$. The arrival of this first-order reflection is delayed by $\Delta t=(t_r-t_d)$, which is proportional to the difference in distance $\Delta d=(d_r-d_d)$. In two dimensions, an ellipse defines the locus of reflection points on paths between two foci at points 210 and 310, separated by a direct-path length $d_d$, having a first-order reflection path length equal to $d_r$ where $d_r>d_d$. The principal axis of the ellipse passes through the foci at points 210 and 310. In three dimensions, the locus of points is defined by the ellipse rotated about its principal axis.

As mentioned above, the use of anechoic chambers may be avoided in preferred embodiments by arranging components in the system such that the first-order reflection delay is at least a specified amount of time, say three milliseconds. Given the speed of sound propagation through air, this is substantially equivalent to removing reflective objects from inside an ellipsoidal-shaped volume having foci at acoustic output transducer 210 and at the center of the head of test subject 302, separated by distance $d_d$, and a surface defined by reflection points on paths having a first-order reflection path length approximately equal to $d_d$+3 feet. This arrangement can be exploited when the HRTF is derived from acoustic measurements, discussed below.

2. Calibrate

Step CALIBRATE 420 calibrates the system by establishing ambient noise level, ambient reverberation time, and signal level appropriate for the comfort of the test subject.

The ambient noise level can be established by averaging the signals received from the acoustic input transducers in the absence of any soundfield generated by the acoustic output transducer. Sources of ambient noise include ventilation and office equipment, vehicular traffic outside the measurement facility, conversations in nearby offices and even the devices used to generate and measure soundfields.

In another embodiment, the ambient noise level is established for each measurement after a test signal is generated and immediately before the arrival of the soundfield at the input transducer along the direct-path. This embodiment is useful in measurement facilities that have a widely fluctuating ambient noise level.

In either embodiment, the established ambient noise level can be used by the GENERATE 440 and MEASURE 450 steps to achieve a desired SNR.

The appropriate signal level can be established by generating a soundfield with the acoustic output transducer in response to a sequence of test signals with increasing amplitude. The amplitude is increased until the test subject indicates that the level of the soundfield is no longer comfortable. The amplitude of subsequent test signals is set somewhat below this level. After this level is set, microphone preamplifier gain and/or analog-to-digital converter (ADC) gain can be adjusted to maximize dynamic range.

Figure 4:
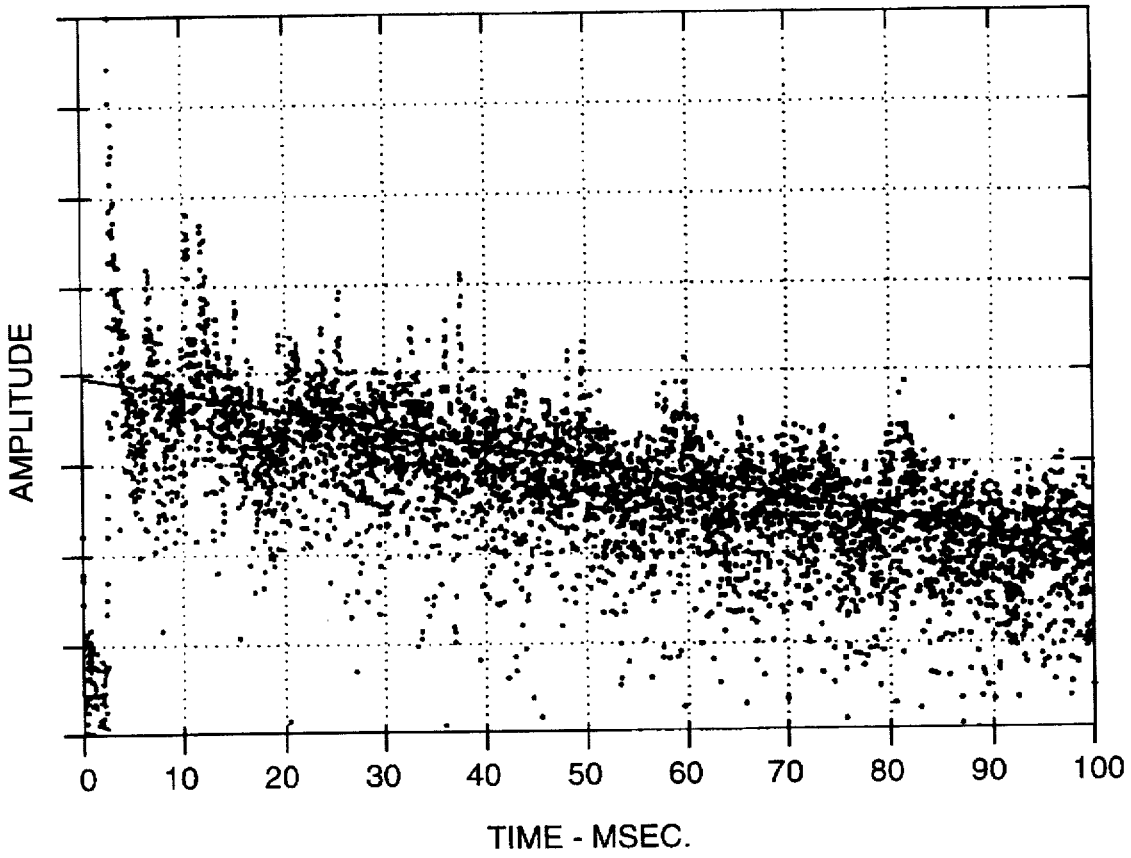
FIG. 4 is a graphical illustration of a measured response showing the T60 decay time of ambient reflections.
Figure 6A:
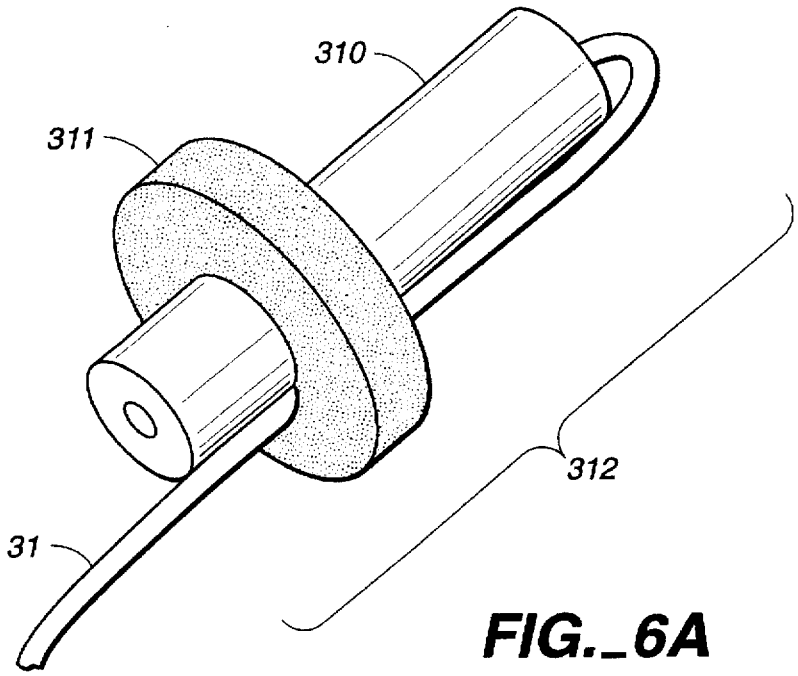
FIG. 6*a* is a schematic illustration a blocked-meatus microphone suitable for use with various aspects of the present invention.
Figure 6B:
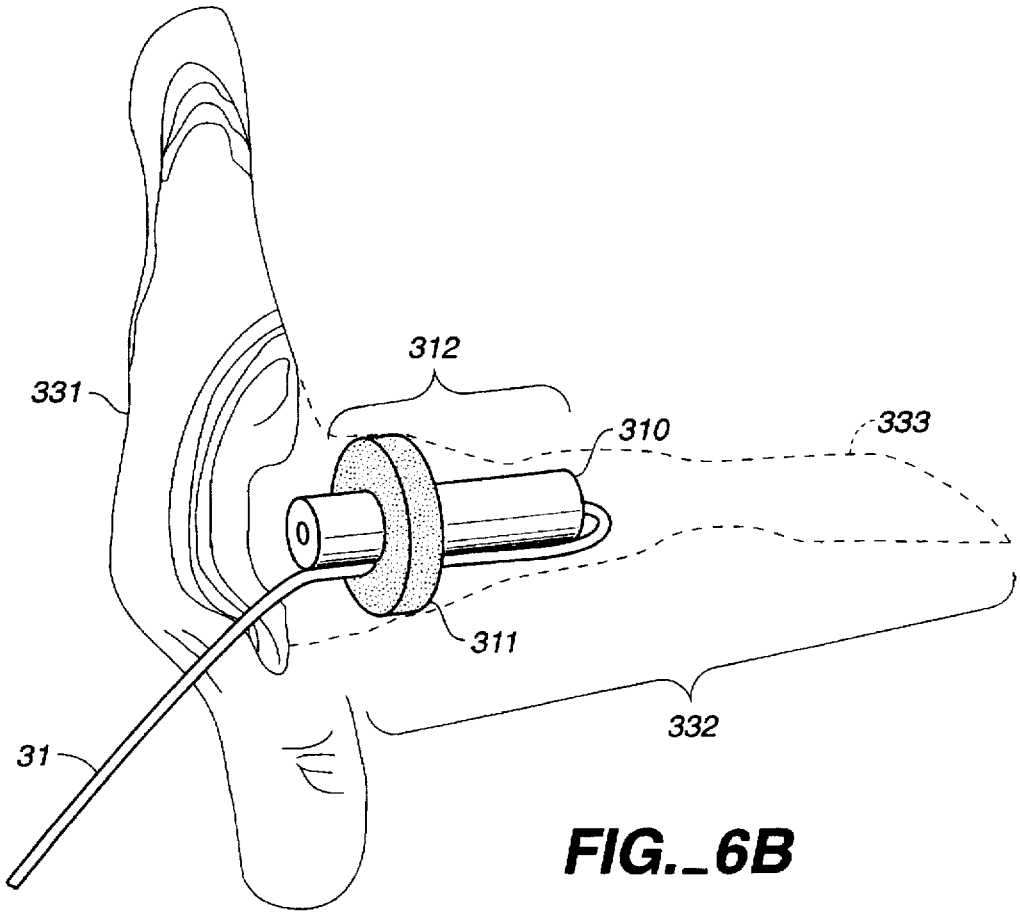
FIG. 6*b* is a schematic illustration a blocked-meatus microphone installed in an ear canal of a test subject.
Figure 7A:
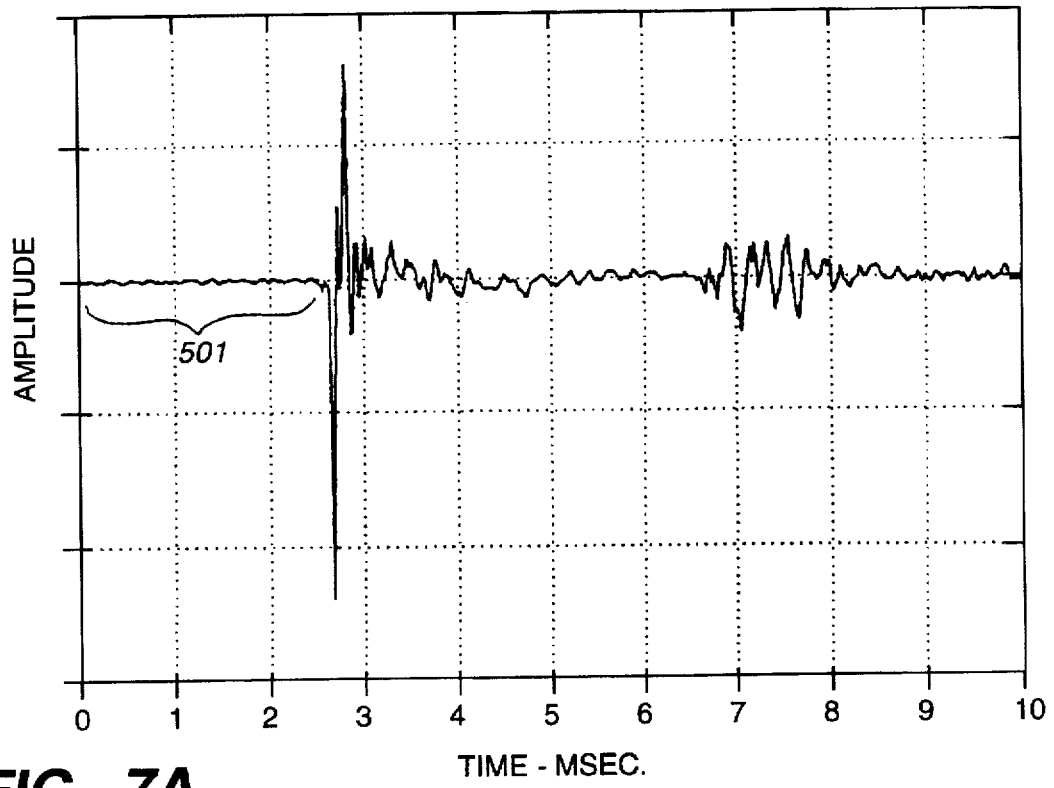
FIGS. 7*a*–7*b* are graphical illustrations of a raw system impulse response showing effects of test subject movement.
Figure 7B:
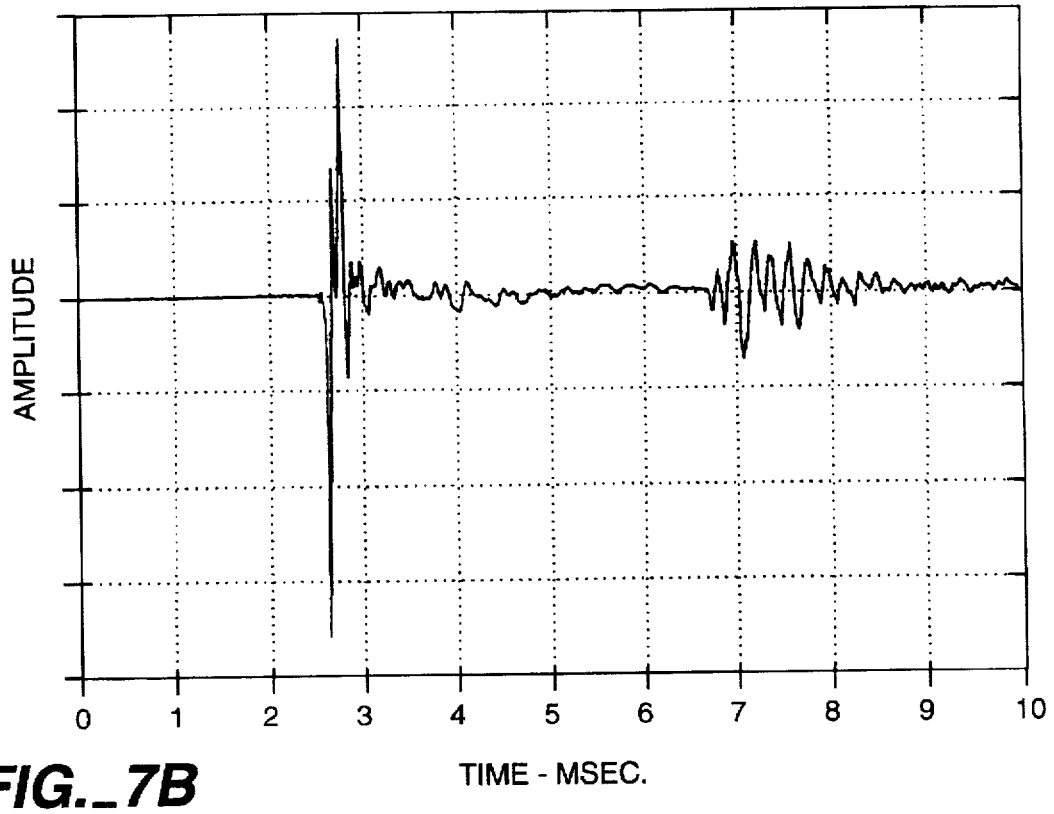

The ambient reverberation time or "T60" time estimates the amount of time required for the measured response to decay to a level 60 dB below the peak amplitude of the response. The T60 time determines how long the system must wait before a successive soundfield may be generated and measured with a desired SNR. An example of a measured response is illustrated in FIG. 4. In the example shown, an extrapolation of a straight line fit to the decaying response indicates that the T60 time is approximately 300 milliseconds.

3. Move

Step MOVE 430 adjusts the relative position between acoustic output transducer and test subject. The measurements taken to derive HRTF vary as a function of the orientation of the test subject relative to the source of the soundfield; therefore, measurements are taken for a plurality of relative positions.

In the embodiment illustrated in FIG. 1, the relative positions between acoustic output transducer 210 and test subject 330 are adjusted manually. Support 201 is depicted as a structure on wheels to facilitate moving the acoustic output transducer laterally along the floor relative to the test subject. Support 202 permits raising and lowering the acoustic output transducer relative to the floor, and support 203 allows the acoustic output transducer to be aimed toward the test subject. Generally, the transducer must be aimed because it does radiate acoustic energy uniformly in all directions. As shown, seat 301 is a chair which rotates about a vertical axis passing through a point at or near the center of the head of the test subject. Although not required, radial lines 303 may be marked on the floor to assist in facing the test subject in a plurality of directions. In another embodiment, alignment marks are placed on walls or other structures at approximately eye level, allowing the test subject to orient himself or herself without appreciable head motion. In yet another embodiment, detents are used to establish various seat orientations.

Many alternatives to the illustrated embodiment are possible. Support 201, for example, may be placed on a moveable stand, on a device moving along a track, or even fixed in one location. Seat 301 may permit raising and lowering the test subject relative to the floor, and/or it may permit lateral motion along the floor. No particular arrangement is critical to the practice of the present invention. In a preferred embodiment, the test subject is rotated and the acoustic output transducer is raised and lowered.

Figure 5:
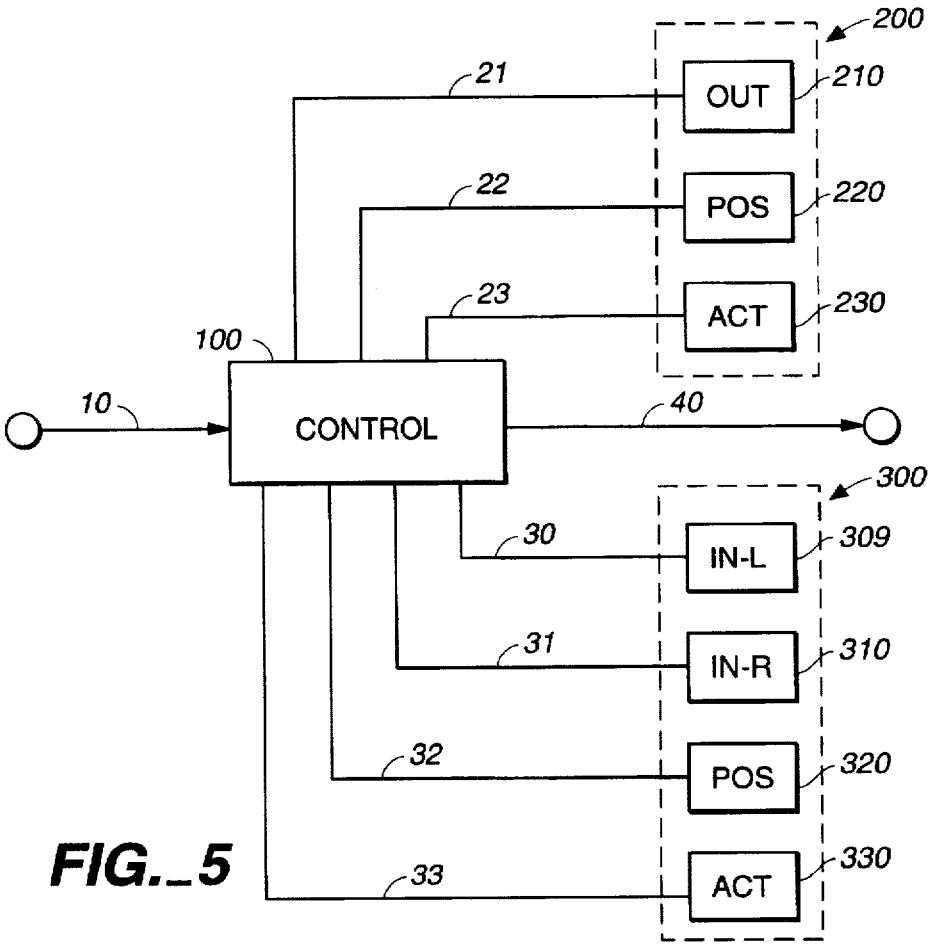
FIG. 5 is a functional block diagram of one embodiment of a system incorporating various aspects of the present invention.

FIG. 5 is a functional block diagram of an embodiment in which control 100 uses one or more actuators 230 to move output unit 200 and one or more actuators 330 to move input unit 300. In the embodiment illustrated in FIG. 1, for example, one or more actuators could be added to raise, lower and/or aim acoustic output transducer 210 and/or one or more actuators could be added to raise, lower and/or rotate seat 301. The actuators could be, for example, electric motors or electro-mechanical, hydraulic or pneumatic actuators.

Position sensors 220 and 320 may be used to provide feedback for a closed-loop control system and allow the relative orientation to be established accurately; however, reasonably good results can be achieved, for example, by using alignment marks as a guide and coordinating the rotation of the test subject with each measurement.

4. Generate

Step GENERATE 440 generates a soundfield in response to a test signal. In the embodiment illustrated in FIG. 1, acoustic output transducer 210 generates a soundfield in response to a test signal received from path 21. Although a wide variety of acoustic output transducers may be used, a loudspeaker is convenient for deriving HRTF. Preferably, the loudspeaker has one small driver to better approximate a single point source of acoustic energy, has a fairly smooth frequency response from about 300 Hz up to about 16 kHz and, if used with an electromagnetic position sensor, is electromagnetically shielded. The advantages realized by using only a single transducer are explained below.

Two suitable products are the Acoustimass™ cube speaker from an AM-3 series III system, manufactured by Bose Electronics, Framingham, Mass., and the ProPerformers manufactured by YBL Corporation, Woodbury, N.Y. Of these two products, the Bose product is generally preferred because it has a flatter frequency response, especially with the grill shield removed, and it is easier to support because it is lighter in weight.

A wide variety of test signals may be used to derive HRTF. In principle, an impulse is an ideal test signal because, by definition, the measured response is the impulse response. As a practical matter, however, true impulses cannot be generated and signals even approximating an impulse either exceed the dynamic range of transducers and measuring equipment or they have insufficient power to allow measurements with sufficient SNR. Much of the noise corrupting acoustical measurements is uncorrelated; therefore, the effects of noise can be reduced by averaging a series of measurements. In principle, the SNR of a two-measurement average is 3 dB higher than the SNR of a single measurement.

To achieve a sufficient SNR, commonly regarded as 60 dB, an excessive number of measurements must be taken. The number of measurements may be controlled by reducing the ambient noise level, increasing the amplitude of the of the test signal and/or using a longer test signal. It is difficult, or expensive, to reduce the ambient noise level below a certain level. Test signal amplitude cannot be increased beyond certain limits without exceeding equipment dynamic range and/or exposing a test subject to uncomfortably loud soundfields. As a result of the first two constraints, test sequences as long as two to five seconds are typically necessary; however, such long test sequences increase the likelihood of test subject movement during the measurements which degrades the accuracy of the measured response.

Pseudorandom noise sequences, such as the maximum-length sequences (MLS) discussed above, may be used to increase SNR; however, the measured response to MLS test signals contains a significant error at low frequencies. In addition, MLS test signals must be at least as long as the raw system impulse response time; therefore, considerable processing is needed to perform required correlation and convolution operations for measurements made in a reflective or reverberant environment.

A preferred test signal which requires less processing is a sequence of one or more Golay code pairs. One example of a binary Golay code pair is A(n)=(1,1) and B(n)=(1,−1). A binary Golay code pair {A,B} has the following property:

$$A(n)\square A(n)+B(n)\square B(n)=2L\delta(n) \tag{1}$$

where □ denotes correlation,

L=length of each Golay code, and

δ(n)=Dirac delta function, which equals 1 for n=0 and equals 0 for n≠0. This property of Golay code pairs can be used to derive a more accurate system impulse response s(n).

The way in which this can be done is based upon the fact that, in response to any input signal x(n), the output y(n) of any system S is $$y(n)=s(n)*x(n) \tag{2}$$

where s(n)=impulse response of system S and

* denotes convolution.

By generating a soundfield in response to Golay code A(n) and measuring the response $y_A(n)$, then generating a soundfield in response to Golay code B(n) and measuring the response $y_B(n)$, it is possible to calculate the system impulse response using the associative property of convolution and correlation as follows:

$$y_A(n) = s(n) * A(n) \tag{3a}$$

$$y_B(n) = s(n) * B(n) \tag{3b}$$

$$\begin{aligned} y_A(n) \square A(n) + y_B(n) \square B(n) = & \\ [s(n) * A(n)] \square A(n) + [s(n) * B(n)] \square B(n) = & \\ s(n) * [A(n) \square A(n)] + s(n) * [B(n) \square B(n)] = & \\ s(n) * [A(n) \square A(n) + B(n) \square B(n)] = & \\ s(n) * 2L\delta(n) = 2Ls(n). & \end{aligned} \tag{3c}$$

Additional information regarding Golay codes may be obtained from Golay, "Complementary Series," *IRE Trans. Info. Theory*, vol. 7, April 1961, pp. 82–87, and Foster, "Impulse Response Measurement Using Golay Codes," *Int. Conf. Acoust., Speech and Sig. Proc.*, 1986, pp. 929–931, both of which are incorporated by reference in their entirety.

In a reflective environment, after driving the system with one Golay code, the system should wait for the entire system impulse response to decay to a low level before driving the system with the other Golay code. In one embodiment, the wait time is the established T60 time discussed above.

5. Measure

Step MEASURE 450 measures the response to the soundfield generated in the previous step. A wide variety of input transducers may be used to measure system responses but, preferably, they are small enough to fit in the ear canal, have a reasonably flat frequency response from about 300 Hz to about 16 kHz. Although blocked-meatus microphones are preferred, a suitable probe microphone is the Entymotic ER-7, manufactured by Entymotic Research, Elk Grove Village, Ill. A suitable transducer for use as a blocked-meatus microphone is the model EA-1934 manufactured by Knowles Electronics, Inc., Itasca, Ill. Another microphone which may be used as a blocked-meatus microphone is the model VM-063T microphone capsule manufactured by Panasonic, Japan, Digi-Key part P9932; however, much better frequency response and linearity can be achieved by switching the source and drain leads of a built-in field-effect transistor (FET).

One embodiment of a blocked-meatus microphone is illustrated in FIG. **6*a*. Blocked-meatus microphone 312 comprises transducer 310 inserted into positioning device 311 which allows the transducer to be positioned in an ear canal. The positioning device may be made of a soft, resilient material such as that used to make conventional ear plugs. In the embodiment shown, path 31 extends from one end of transducer 310 and passes through positioning device 311**.

FIG. **6*b* illustrates right ear pinna 331 and meatus or ear canal 332 of test subject 330, and blocked-meatus microphone 312 installed in the ear canal. The microphone is held in place by positioning device 311 which also blocks or inhibits acoustic energy from propagating into the ear canal. Because a blocked-meatus microphone need not be installed near area 333** at the ear drum, the training and care required for safe installation are greatly reduced.

Blocked-meatus microphones installed near the opening of the ear canal are preferred to probe microphones installed near the ear drum because they offer the following advantages: (1) more easily installed; (2) generally provide a higher SNR because they are physically bigger and are more sensitive to soundfields; (3) permit use of louder soundfields because the soundfield is inhibited from propagating into the ear canal and reaching the ear drum; and (4) are not subject to ear canal acoustic nulls. In addition, because they are installed near the opening to the ear canal, blocked-meatus microphones are not subject to ear canal resonance which increases the length of the raw system impulse response and which decreases the accuracy of measurements for frequencies away from the ear canal resonant frequency.

If accurate HRTF are to be derived, it is important to install a blocked-meatus microphone far enough into the ear canal so that the measured signal contains all of the directional cues developed by the outer ear. In other words, the measured response should not include any directional dependencies. There is also concern that a blocked-meatus microphone may distort the sound field outside the ear canal. Empirical evidence has shown that satisfactory results are achieved by installing a blocked-meatus microphone about 0.5 cm into the ear canal.

If position sensors are incorporated into an embodiment of the present invention, a wide range of position-sensing techniques, including electromagnetic and optical techniques, may be used. If an electromagnetic technique is used, care should be exercised to ensure that other equipment such as the acoustic output transducer does not interfere. Examples of suitable electromagnetic sensors are the ISOTRAK II™, InsideTRAK™ and the FASTRAK™, manufactured by Polhemus Corporation, Colchester, Vt.

Referring to FIG. 1, in an embodiment comprising the InsideTRAK sensor, position sensor 220 is a radiator and position sensor 320 is a receiver capable of detecting three degrees of translational position and three degrees of rotational position relative to the radiator. Control 100 comprises an IBM® PC compatible personal computer with a circuit card that passes control signals along path 22 to control the radiator and receives signals along path 32 from the receiver. The circuit card processes the signals from the receiver to establish the relative position. In an embodiment comprising the FASTRAK sensor, a control circuit external to control 100 and not shown in any figure interacts with the radiator and the receiver along paths 22 and 32, respectively, passing relative position information to control 100 along a path not shown.

Position sensors are not required in embodiments incorporating various aspects of the present invention. In an embodiment such as that illustrated in FIG. 1, the orientation of the head relative to acoustic output transducer 210 can be established with reasonable accuracy by placing support 201 in a known position relative to test subject 330 and using alignment marks to assist rotating test subject 330 to desired orientations. The distance between the acoustic output transducer and the head can be established from the measured response itself using a technique described below.

6. Validate

Step VALIDATE 460 ascertains the validity of the measured responses and, if the response is not valid, causes soundfield generation and response measurement to be repeated for the current relative position. Two sources of invalidation are test subject movement while a measurement is taken and loud, short-duration ambient sounds.

Test subject movement can be checked easily if position sensors are used. If the test subject moves during a measurement and the movement is considered to be too great, the previous measurement can be invalidated and taken again. This may be accomplished automatically if control 100 also controls the relative position of test subject and output transducer using actuators. Validation may also be accomplished in embodiments where repositioning is done manually by generating a signal such as an audible or visual alarm indicating that the previous measurement is to be taken again.

Movement validation also may be accomplished by analyzing the measured response itself, particularly in embodiments using Golay code test signals as described above. Responses measured during head movement are muddled as compared to responses measured without appreciable head movement. The response illustrated in FIG. *7a* represents a response obtained using Golay code test signals with head movement occurring between the generation of each test signal. This response, as compared to the response illustrated in FIG. *7b* taken without head movement, for example, contains a discernible noise-like signal in interval 501 immediately preceding the onset of the measured response.

In embodiments using Golay code test signals, the effect of loud, short-duration ambient sounds is very similar to the effects of test subject movement; therefore, they can be detected in a similar manner.

7. Reiterate

Step REITERATE 470 causes measurements to be taken for a plurality of relative positions by reiterating the steps that adjust the relative position between acoustic output transducer and test subject, generate a soundfield and measure the response in each ear for each relative position. When all measurements have been taken, the following step derives an equalized HRTF.

8. Derive

Step DERIVE 480 derives an equalized HRTF from the measured responses as a function of relative position. The equalized HRTF may be derived by (1) establishing the raw system impulse response, (2) establishing the raw direct-path impulse response by removing the effects of acoustic reflections from the raw system impulse response, (3) deriving an unequalized transfer function from the raw direct-path impulse response, and (4) deriving an equalized HRTF from the unequalized transfer function by accounting for the acoustical properties of the output and input transducers. As explained above, the raw system impulse response is the impulse response of the entire measurement system at the input transducer to a soundfield originating from the output transducer, including all reflections and acoustical properties of the output and input transducers. The raw direct-path impulse response is the impulse response at the input transducer to only the soundfield originating at the output transducer and traveling along a direct path to the input transducer, including the acoustical properties of the output and input transducers.

a. Raw System Impulse Response

The measured response of the system to a test signal may be expressed as $$y(n)=s(d,\theta,\phi,n)*x(n) \tag{4}$$

where $s(d,\theta,\phi,n)$=raw system impulse response, $(d,\theta,\phi)$=relative position between output and input transducers, $x(n)$=test signal driving the output transducer, and $y(n)$=response of system measured at the input transducer.

The raw system impulse response, which can be obtained by deconvolving the test signal x(n) from the measured response y(n), may be expressed as $$s(d,\theta,\phi,n)=r(d,\theta,\phi,n)+g(d,\theta,\phi,n) \quad (5)$$

where r(d,θ,ϕ,n)=impulse response of the system caused by reflections and g(d,θ,ϕ,n)=raw direct-path impulse response.

b. Raw Direct Path Impulse Response

The portion of the raw system impulse response due to reflections may be removed in several different ways. A preferred way removes the effects of reflections by constraining system reflection geometry such that the earliest reflection arrives at the input transducer after the arrival of the direct-path response by some amount, say 3 milliseconds, and by applying a time-domain window to the measured response to remove the effects of the reflections.

The minimum delay required is dictated by the length of the raw direct-path impulse response itself. Input transducers installed at or near the ear canal opening, as opposed to input transducers installed near the ear drum, help reduce the length of the impulse response by eliminating the effects of ear canal resonance. Ear canal resonance can extend the raw direct-path impulse response by several milliseconds. The use of blocked-meatus microphones installed near the ear canal opening and Golay code test signals helps reduce the amount of delay required.

Figure 8:
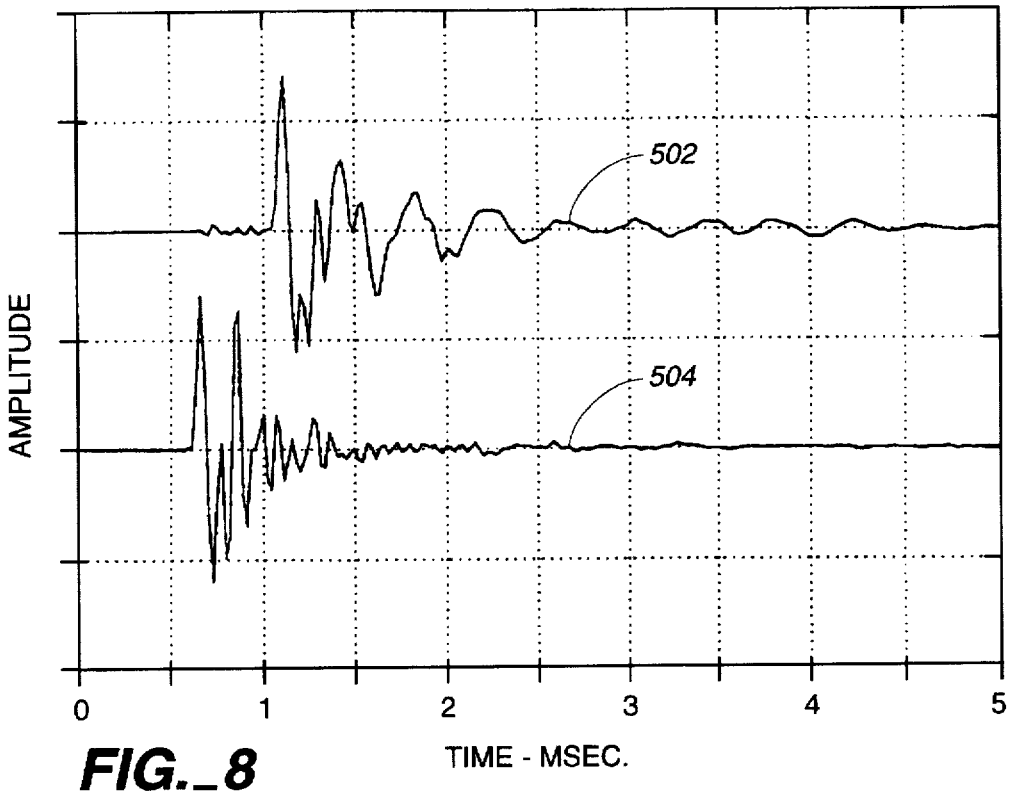
FIG. 8 is a graphical illustration comparing measured responses of a probe installed near the ear drum and a blocked-meatus microphone installed near the ear canal opening.

FIG. 8 illustrates the relative performance of a blocked-meatus microphone installed near the ear canal opening as compared to a probe microphone installed near the ear drum. Response 502 and response 504 are measured responses for the probe microphone and the blocked-meatus microphone, respectively. The duration of response 502 is considerably longer than the duration of response 504 because of ear canal resonance. In addition, propagation time in the small tube conveying energy from the probe microphone to a measuring device outside the ear canal delays the onset of response 502 relative to response 504, and acoustic coupling to the tube also injects a noise-like component into response 502 just prior to the peak.

Figure 9A:
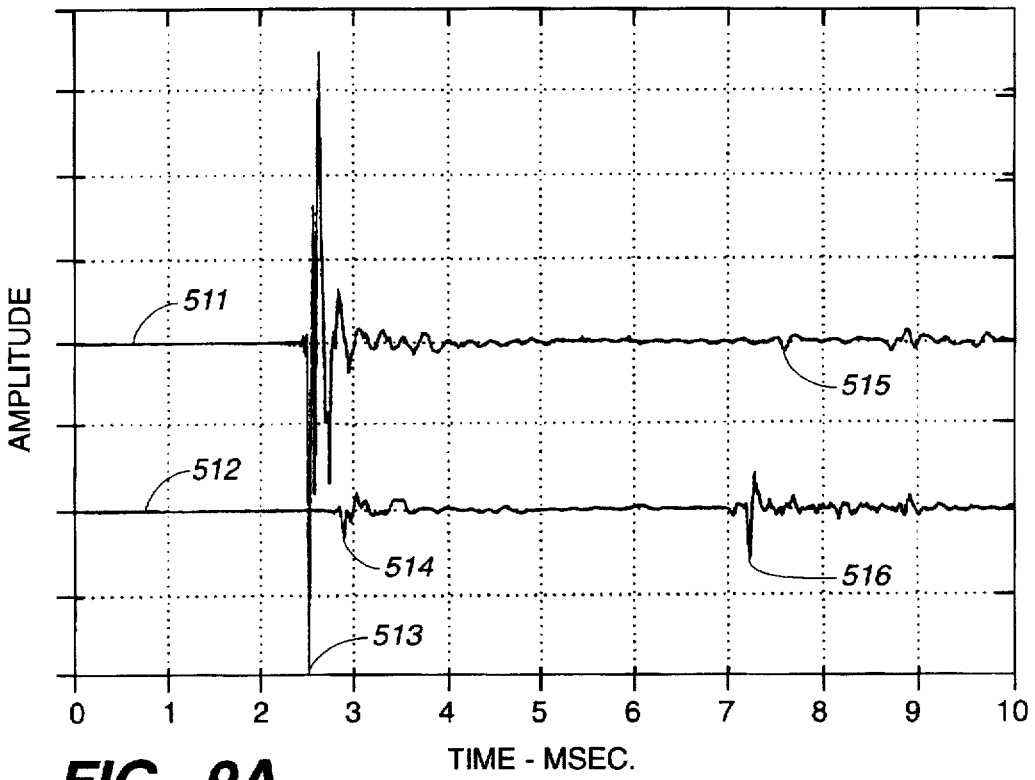
FIGS. 9*a*–9*b* are graphical illustrations of a raw system impulse response showing removal of reflection effects by use of a window.

In FIG. 9*a*, waveform 511 and waveform 512 represent raw system impulse responses to a soundfield measured in the right ear and left ear, respectively, of a test subject. In the left ear, response 516 to the earliest reflection occurs approximately 4.5 milliseconds after peak response 514 to direct-path propagation. In the right ear, response 515 to the earliest reflection occurs approximately five milliseconds after peak response 513 to direct-path propagation. Peak response 513 of waveform 511 extends below waveform 512 in the illustration.

Figure 9B:
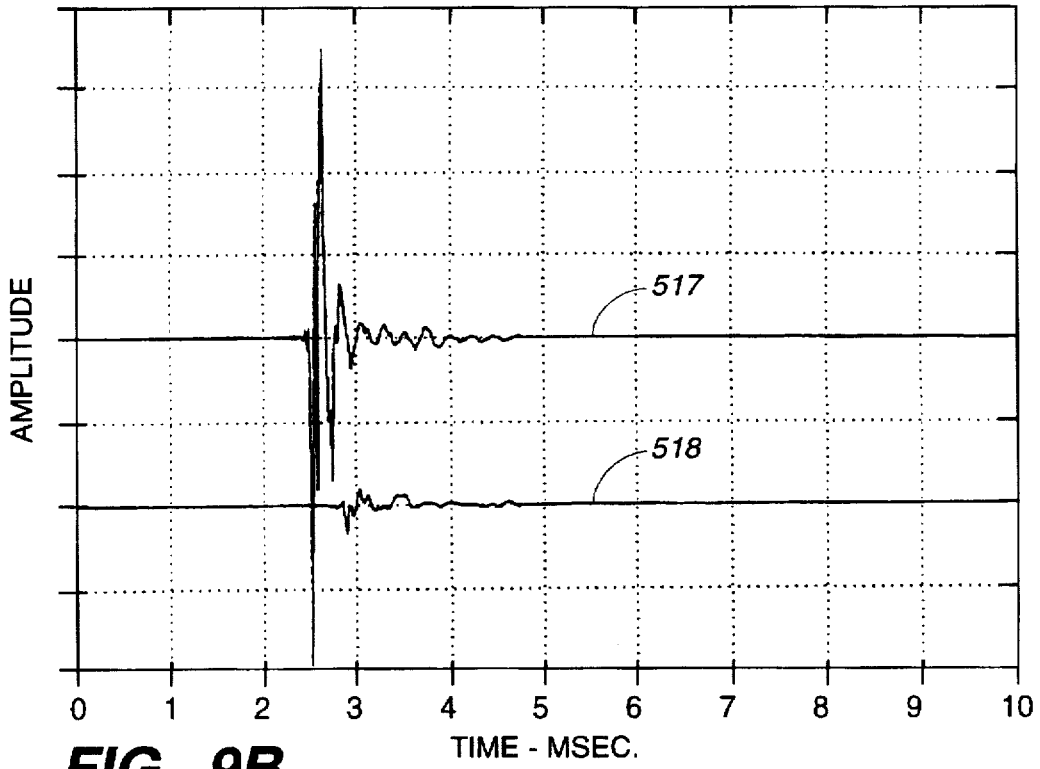

FIG. 9*b* illustrates raw direct-path impulse responses 517 and 518 for the right ear and left ear, respectively, obtained by applying a rectangular window to the raw system impulse responses to remove the effects of reflections. Although the window used in the example shown is a rectangular window, it may be desirable to use a smoother-shaped window to reduce frequency-domain artifacts in the raw direct-path impulse response. In addition, the same or different windows may be used to remove the effects of reflections from the right-ear and left-ear responses.

A second way for removing the effects of reflections establishes a reflection model based upon the geometry and acoustical properties of the system. In effect, this way attempts to construct a model for the r(d,θ,ϕ,n) impulse response, and removes the effects of reflections by fitting the model to the measured response and subtracting the result from the raw system impulse response. One implementation of this way is discussed by Ainsleigh and George, cited above.

A third way for removing the effects of reflections attempts to identify the raw direct path impulse response by extrapolating an initial segment of the raw system impulse response. One implementation of this way, which uses linear prediction and least-squares solutions to estimate a steady-state response, is discussed by George, Jain and Ainsleigh, cited above.

An alternative to each of the three ways just discussed comprises generating a reflection-free response by applying similar techniques to remove the effects of reflections from the measured response rather than the raw system impulse response. A direct-path impulse response can then be obtained by deconvolving the test signal from the reflection-free response.

Equivalent results can be obtained using corresponding procedures performed in the frequency domain.

c. Unequalized Transfer Function

The raw direct-path impulse response, as shown above, is dependent on distance; however, so called "far field" effects of distance on sound field direct-path propagation can be expressed analytically by the inverse-square law. Empirical evidence has shown that far field effects occur at distances greater than about 1.5 feet. As a result, it is possible to derive HRTF which are not functions of distance.

Well known methods for deriving HRTF remove the dependency on distance by generating soundfields from output transducer kept at a constant distance from the center of the head of the test subject. For example, McKinley and Erickson at the Bioacoustics Laboratory in the Armstrong Laboratory at Wright-Patterson Air Force Base, Dayton, Ohio, places the head of the test subject at the center of a geodesic anechoic chamber comprising 265 loudspeakers. As another example discussed in the Wightman-Headphone reference, cited above, the chamber comprises loudspeakers mounted on a semicircular structure with the head of the test subject placed at the center of a line subtending the semicircle.

In accordance with various aspects of the present invention, one or more output transducers may be placed at any convenient distance from the test subject. The distance between output transducer and test subject may be established by position sensors as described above, or the distance may be derived from the measured responses. This may be accomplished conveniently from raw direct-path impulse responses.

Figure 10:
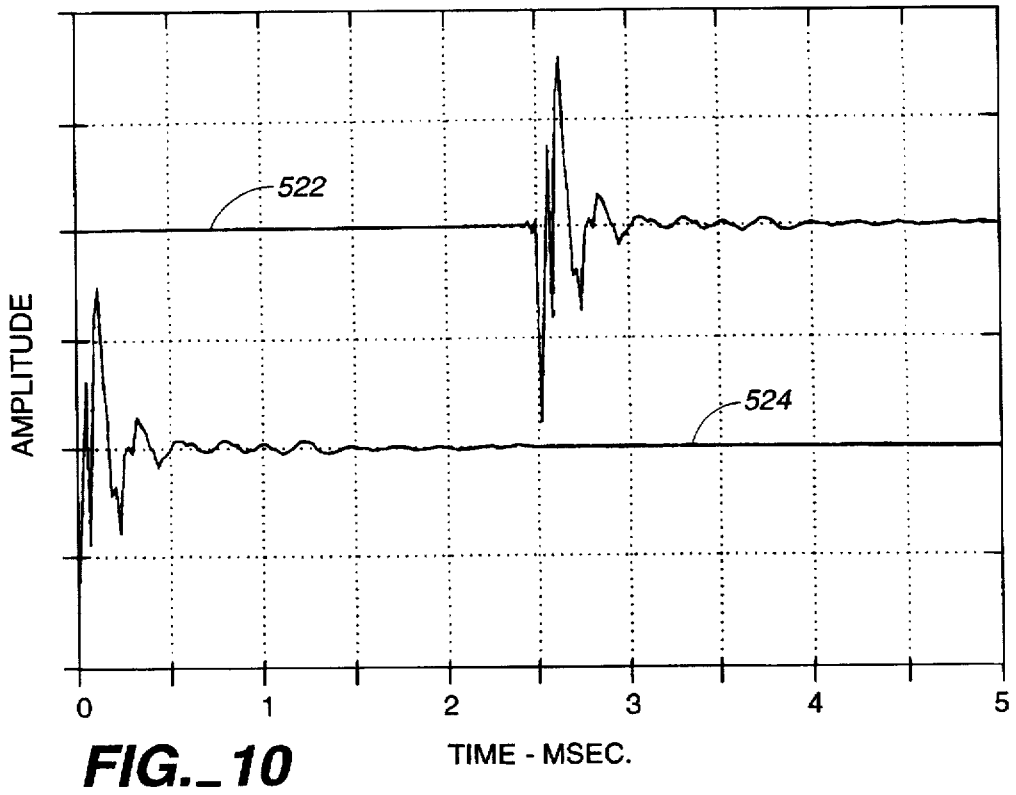
FIG. 10 is a graphical illustration of a raw direct-path impulse response and a corresponding minimum-phase response.

In FIG. 10, waveform 522 represents a raw direct-path impulse response and waveform 524 represents a corresponding minimum-phase impulse response. Waveform 524 is essentially a time-shifted replica of waveform 522. The minimum-phase response may be obtained using homomorphic filtering or any other convenient technique such as those described in Oppenheim and Schafer, "Discrete-Time Signal Processing," 1989, especially pp. 781–797, which is incorporated by reference. The conversion to minimum phase preserves the response magnitude and effectively shifts the response in time. The amount of this time shift can be established by cross-correlating the minimum-phase response with the raw direct-path impulse response and finding the correlation peak.

If digital techniques are used, each response is represented by discrete points and the resolution of the crosscorrelation function may be too coarse to identify the peak with sufficient accuracy. Resolution can be enhanced by upsampling or interpolating the function around the peak. In one embodiment, the shift is established by parabolic interpolation of the peak value and the two neighboring values.

The time shift required to obtain the minimum-phase response for the left ear is the sum of system delays $\Delta t_s$ and direct-path propagation time $\Delta t_L$ between the output transducer and the left ear. System delays occur because of delays in various components such as digital-to-analog converters (DAC) for soundfield generation and analog-to-digital converters (ADC) for soundfield measurement. The time shift required to obtain the minimum-phase response for the right ear is the sum of system delays $\Delta t_s$ and direct-path propagation time $\Delta t_R$ between the output transducer and the right ear. The distance between the output transducer and the center of the head is substantially equal to the average direct-path propagation time or $\frac{1}{2}(\Delta t_L+\Delta t_R)$. The difference between the two time shifts ($\Delta t_{L-\Delta tR}$) is the interaural time difference (ITD). The minimum-phase responses are used to obtain the ITD and, optionally, the estimated distance but they are not used in subsequent derivations of HRTF.

If probe microphones are used, all distance and ITD calculations must account for propagation time in the small tubes used to convey energy from the microphones to a measuring device outside the ear canal.

Having established the distance for each respective measured raw direct-path impulse response, the measured responses can be expressed in terms of functions f and $\hat{h}$ such that $$g(d,\theta,\phi,n)=f(d,n) * \hat{h}(\theta,\phi,n) \tag{6a}$$

which may be expressed in the frequency domain as $$G(d,\theta,\phi,\omega)=F(d,\omega)\cdot\hat{H}(\theta,\phi,\omega) \tag{6b}$$

where $G(d,\theta,\phi,\omega)$=raw direct-path transfer function, and $F(d,\omega)$=transfer function dependent on distance and frequency, and $\hat{H}(\theta,\phi,\omega)$=unequalized transfer function.

The transfer function $F(d,\omega)$ may be approximated by $1/d^2$ because high-frequency attenuation can be neglected for the small distances normally present in measuring systems; thus, the unequalized transfer function may be obtained easily from the raw direct-path transfer function according to $$\hat{H}(\theta,\phi,\omega)=\frac{G(d,\theta,\phi,\omega)}{d^2} \tag{7}$$

in situations where the transfer function $F(d,\omega)$ is approximated at least reasonably well by the inverse square law.

d. Head-Related Transfer Function

The unequalized transfer function is unequalized in the sense that it is dependent on output and input transducer acoustic properties. The unequalized transfer function may be expressed in terms of the desired equalized HRTF as $$\hat{H}(\theta,\phi,\omega)=O(\theta,\phi,\omega)\cdot I(\theta,\phi,\omega)\cdot H(\theta,\phi,\omega) \tag{8a}$$

where $O(\theta,\phi,\omega)$=transfer function of acoustic output transducer, $I(\theta,\phi,\omega)$=transfer function of acoustic input transducer, and $H(\theta,\phi,\omega)$=equalized HRTF.

As discussed above, directional cues are well developed at a point only a few millimeters inside the ear canal; therefore, if the input transducer is installed far enough into the ear canal, the transfer function for the input transducer can be simplified and expressed as a function independent of relative direction. If the output transducer is aimed toward the test subject throughout the measurements, then the transfer function for the output transducer can also be approximated by a function which is independent of relative direction. Therefore, expression 8a can be rewritten as $$\hat{H}(\theta,\phi,\omega)=O(\omega)\cdot I(\omega)\cdot H(\theta,\phi,\omega) \tag{8b}$$

and the equalized HRTF can be obtained from $$H(\theta,\phi,\omega)=\frac{\hat{H}(\theta,\phi,\omega)}{O(\omega)\cdot I(\omega)} \tag{9}$$

if the transfer functions of the transducers are known.

In systems comprising more than one acoustic output transducer, equalization is more difficult because each output transducer has unique acoustical properties. Equalization should be performed according to the acoustical properties of the output transducer associated with each respective measured response. In embodiments such as the one shown in FIG. 1, equalization is much simpler because only one output transducer is used; hence, the same equalizing adjustments may be performed for every measured response.

In certain situations, HRTF derived from measurements using a single output transducer need not be equalized for transducer acoustical properties. One situation arises for applications where HRTF are intended for use in an acoustic display comprising headphones or other transducers having a transfer function reasonably close to a diffuse-field response, or which differs from a diffuse-field response in a known way. Differences between HRTF established at various points along the ear canal are reasonably independent of relative direction; therefore, it can be assumed that an equalized HRTF with respect to the ear drum may be expressed as $$H'(\theta,\phi,\omega)=C(\omega)\cdot H(\theta,\phi,\omega) \tag{10}$$

where $H'(\theta,\phi,\omega)$=equalized HRTF with respect to the ear drum and $C(\omega)$=transfer function through the ear canal to the ear drum.

For an acoustical display using headphones, the equalized transfer function is $$H'(\theta,\phi,\omega)=C(\omega)\cdot P(\omega)\cdot X(\theta,\phi,\omega) \tag{11}$$

where $P(\omega)$=headphone transfer function with respect to ear canal opening anda $X(\theta,\phi,\omega)$=equalized HRTF with respect to the ear canal opening.

Therefore, to deliver the appropriate acoustic signal to the ear drum, the equalized HRTF must be given by $$X(\theta,\phi,\omega)=\frac{H(\theta,\phi,\omega)}{P(\omega)} \tag{12}$$

Most manufactures attempt to produce headphones which have a transfer function P approximating a diffuse-field response, or $$P(\omega)\simeq\sqrt{\sum_{\theta,\phi}|H(\theta,\phi,\omega)|^2} \tag{13}$$

Even if the equalized HRTF and the diffuse-field response are not known, when a single output transducer is used as discussed above, it is easy to obtain $$\frac{\hat{H}(\theta,\phi,\omega)}{\sqrt{\sum_{\theta,\phi}|\hat{H}(\theta,\phi,\omega)|^2}}=\frac{O(\omega)\cdot I(\omega)\cdot H(\theta,\phi,\omega)}{O(\omega)\cdot I(\omega)\cdot\sqrt{\sum_{\theta,\phi}|H(\theta,\phi,\omega)|^2}}\simeq\frac{H(\theta,\phi,\omega)}{P(\omega)} \tag{14}$$

from the measured unequalized transfer function. From expression 12, it can be seen that this is the desired equalized HRTF for an acoustic display using headphones or other transducers as described above.

Headphones and other output transducers which have a transfer function P which differs from a diffuse-field response in a known way, Q(ω), can sometimes be expressed as $$P(\omega)\simeq\sqrt{\sum_{\theta,\phi}|H(\theta,\phi,\omega)|^2}\cdot Q(\omega) \tag{15}$$

The desired equalized HRTF can be obtained in a similar manner as shown in the following expression:

$$\frac{1}{Q(\omega)}\cdot\frac{\hat{H}(\theta,\phi,\omega)}{\sqrt{\sum_{\theta,\phi}|\hat{H}(\theta,\phi,\omega)|^2}}=\frac{H(\theta,\phi,\omega)}{Q(\omega)\cdot\sqrt{\sum_{\theta,\phi}|H(\theta,\phi,\omega)|^2}}\simeq\frac{H(\theta,\phi,\omega)}{P(\omega)} \tag{16}$$

This approach can be used for other types of acoustic displays such as so called "near phones" or loudspeakers located near the ear canal opening. The loudspeaker near the left ear is located at (θ,ϕ)=(90,0) degrees and the loudspeaker near the right ear is located at (θ,ϕ)=(270,0) degrees. For simplicity, reference to elevation angle ϕ will be omitted from the following discussion.

From expression 8b it is known that the measured unequalized transfer function for the left loudspeaker is $$\hat{H}(90,\omega)=O(\omega)\cdot I(\omega)\cdot H(90,\omega) \tag{17}$$

Assuming that the left ear is blocked from the right loudspeaker, the effective transfer function for the left ear with respect to the ear drum is $$H'(\theta,\omega)=C(\omega)\cdot P_L(\omega)\cdot X(\theta,\omega)=C(\omega)\cdot H(90,\omega)\cdot Q_L(\omega)\cdot X(\theta,\omega) \tag{18}$$

where $P_L(\omega)$=transfer function of left loudspeaker with respect to ear canal opening, $Q_L(\omega)$=known frequency response characteristics of left loudspeaker, and $X(\theta,\omega)$=desired equalized HRTF.

From expressions 10, 17 and 18 it can be seen that the desired equalized HRTF $X(\theta,\omega)$ can be obtained in terms of the measured unequalized HRTF as follows:

$$\frac{1}{Q_L(\omega)}\cdot\frac{\hat{H}(\theta,\omega)}{\hat{H}(90,\omega)}=\frac{O(\omega)\cdot I(\omega)\cdot H(\theta,\omega)}{O(\omega)\cdot I(\omega)\cdot H(90,\omega)\cdot Q_L(\omega)}\simeq\frac{H(\theta,\omega)}{P_L(\omega)} \tag{19}$$

The HRTF for the right loudspeaker may be obtained in a similar manner.

In preferred embodiments, the derived HRTF are converted into minimum-phase form using techniques such as those mentioned above. Minimum-phase HRTF can be implemented more efficiently in acoustic displays.

C. Alternative Embodiments and Features

In the previous discussion, more particular mention was made of an embodiment implemented with digital techniques. It should be appreciated that the various aspects of the present invention may be implemented using either analog or digital techniques.

In some applications, it is important to derive HRTF with respect to prescribed relative locations. If an embodiment comprises position sensors and actuators which control 100 may use to position the test subject with respect to output transducers, then measurements may be taken at prescribed relative locations and the HRTF may be derived directly from the measurements.

If relative positions are controlled manually, precise control of the relative positions is very difficult. It is still possible, however, to derive HRTF for precise relative positions if position sensors are used. HRTF for the prescribed positions can be obtained by spatially resampling the HRTF and the ITD derived from the somewhat arbitrary relative positions. Spatial resampling may be accomplished in any convenient manner. A simple technique which provides good results is linear interpolation of HRTF and ITD between adjacent points in each of two dimensions (θ,ϕ). If minimum-phase HRTF are desired, the interpolation should be performed before the HRTF are converted to minimum phase.

In another embodiment, the spectral content of the test signal is altered to equalize effects caused by imperfections in acoustic output transducers and/or acoustic input transducers. Alternatively, in embodiments using probe microphones installed near the ear drum, spectral content of the test signals can be can be altered to offset ear canal resonance; however, since the ear canal resonant frequency varies among test subjects, the resonant frequency should first be established.

We claim:

1. A method for deriving an acoustic transfer function comprising the steps of generating a test signal, generating a sound field at a first position in response to said test signal, measuring said sound field at a second position using a blocked-meatus microphone installed at or near the opening of an ear canal of a live test subject to generate a measured signal, obtaining a raw system impulse response from said measured signal and said test signal, obtaining a raw direct-path impulse response by removing effects of reflections from said raw system impulse response, and deriving said acoustic transfer function from said raw direct-path impulse response, wherein said acoustic transfer function represents acoustic levels and phase of said soundfield at said second position.

2. A method according to claim 1 wherein said effects of reflections are removed from said raw system impulse response by either extrapolating said raw system impulse response from an initial segment prior to a first reflection, or subtracting from said raw system impulse response an estimate of said effects of reflections, wherein said estimate is obtained by applying a reflection model to said raw system impulse response.

3. A method according to claim 1 further comprising a step of establishing an ambient noise level, wherein said generating a test signal adapts amplitude of said test signal in response to said ambient noise level.

4. A method according to claim 1 further comprising a step of establishing an ambient reverberation time, wherein said generating a test signal generates a sequence of test signals each separated from one another by at least said ambient reverberation time.

5. A method according to claim 1 wherein said generating a test signal generates a pair of test signals in response to a pair of binary codes having autocorrelation functions with complementary sidelobes.

6. A method according to claim 1 wherein said generating a test signal adapts spectral content of said test signal to equalize frequency response characteristics of said acoustic output transducer and/or said acoustic input transducer.

7. A method according to claim 1 wherein said soundfield is generated by a single acoustic output transducer.

8. A method for deriving an acoustic transfer function comprising the steps of adjusting relative position of a test subject with respect to an acoustic output transducer, generating a test signal, generating a soundfield originating at said acoustic output transducer in response to said test signal, measuring said soundfield at a point near or on the surface of said test subject to generate a measured signal, establishing a distance and/or relative orientation between said acoustic output transducer and said test subject, and deriving said acoustic transfer function from said measured signal and said distance and/or said one or more components of relative orientation, wherein said acoustic transfer function represents acoustic levels and phase of said soundfield at said point near or on the surface of said test subject, and wherein said deriving approximates said acoustic transfer function as a combination of two functions, one of which is independent of relative distance between said test subject and said acoustic output transducer, and the other of which is independent of relative orientation between said test subject and said acoustic output transducer.

9. A method for deriving an acoustic transfer function comprising the steps of adjusting relative position of a test subject with respect to an acoustic output transducer, generating a test signal, generating a soundfield originating at said acoustic output transducer in response to said test signal, measuring said soundfield at a point near or on the surface of said test subject to generate a measured signal, establishing a distance and/or relative orientation between said acoustic output transducer and said test subject, wherein said distance is established in response to said measured signal and said test signal, and deriving said acoustic transfer function from said measured signal and said distance and/or said one or more components of relative orientation, wherein said acoustic transfer function represents acoustic levels and phase of said soundfield at said point near or on the surface of said test subject.

10. A method for displaying a sound having an apparent relative direction to a listener, comprising the steps of selecting and/or adapting an acoustic transfer function in response to said apparent relative direction, wherein said acoustic transfer function is preestablished by performing a method according to any one of claims 1, 2, 3, 4, 5, 6, 7, 8 or 9, generating a first signal representing said sound, generating an output signal by applying said selected and/or adapted acoustic transfer function to said first signal, and generating a soundfield for display to said listener in response to said output signal.

* * * * *